US006527496B2

(12) United States Patent
Espanel et al.

(10) Patent No.: US 6,527,496 B2
(45) Date of Patent: Mar. 4, 2003

(54) LOADER BOOM REINFORCEMENT

(75) Inventors: Christophe Espanel, Dampierre (FR); Cyrille Vittet, Arc-les-Gray (FR)

(73) Assignee: Deere & Company, Moline, IL (US)

( * ) Notice: Subject to any disclaimer, the term of this patent is extended or adjusted under 35 U.S.C. 154(b) by 10 days.

(21) Appl. No.: 09/847,270

(22) Filed: May 2, 2001

(65) Prior Publication Data

US 2001/0038789 A1 Nov. 8, 2001

(30) Foreign Application Priority Data

May 5, 2000 (DE) ..... 100 22 021

(51) Int. Cl.[7] ..... E02F 9/14
(52) U.S. Cl. ..... 414/722; 29/897.31
(58) Field of Search ..... 414/722; 52/111, 52/114, 116; 29/891, 891.1, 897.2, 897.3, 897.31, 897.312

(56) References Cited

U.S. PATENT DOCUMENTS

| | | | | |
|---|---|---|---|---|
| 2,755,572 A | | 7/1956 | Pilch | |
| 3,890,696 A | * | 6/1975 | Buske | 29/897.3 |
| 5,152,659 A | * | 10/1992 | Waka | 414/722 |
| 5,611,657 A | * | 3/1997 | Peterson | 414/722 |

FOREIGN PATENT DOCUMENTS

| | | |
|---|---|---|
| FR | 2379657 | 9/1978 |

* cited by examiner

*Primary Examiner*—Donald W. Underwood

(57) ABSTRACT

A loader boom has arms constructed as tubes that are rectangular in cross section and taper from a bracket for mounting the arms to a tractor. The tubes are each formed by bending a blank of steel material so as to create four 90° corners with opposite ends of the blank extending parallel to each other and forming a gap along, and in the center of, an under side of the tube. A reinforcing bar is located in the gap and secured to the tube by fillet welds.

6 Claims, 1 Drawing Sheet

LOADER BOOM REINFORCEMENT

FIELD OF THE INVENTION

The present invention concerns a loader boom arm, especially an arm for a front end loader wherein the arm is constructed so as to be in the form of a tube.

BACKGROUND OF THE INVENTION

Loaders are installed, for example, on farm tractors and are moveable vertically for lifting loads. In the case of a front loader, the loader includes a loader boom having a forward end to which implements are attached, while the rear end is connected in an articulated manner to the farm tractor. Due to the length of the loader boom, and the forces involved, substantial bending moments arise in the loader arms constituting the boom. Various measures have been attempted in the known loader boom arms to make a basically square tube-like support that is more resistant to bending. For example, it is known to weld to U-channel sections together to form a rectangular tube or to insert two squared sections that are approximately 75% closed together and weld them in place to form a tube. According to another known design, two hollow sections partially; open on the broad side are placed on each other and welded together to form a closed tube resistant to bending.

The problem underlying the invention is that the known loader linkage arms are too expensive.

SUMMARY OF THE INVENTION

According to the present invention, there is provided a loader boom arm construction that represents a less expensive option to the aforementioned known designs.

An object of the invention is to provide a relatively inexpensive loader boom arm construction having a tubular configuration preferably defined by no more than two components with one of the components being simple bar.

A more specific object of the invention is to provide a loader boom arm formed of a first component bent from a sheet of material, so as to form a tube having a slot at one side defined by parallel edges of said sheet material, and a second component in the form of a rectangular bar received in the slot defined by the first component and welded to the first component at locations extending along the opposite sides of the slot.

These and other objects will become apparent from a reading of the ensuing description together with the appended drawings.

DESCRIPTION OF THE PREFERRED EMBODIMENT

Figure 1:
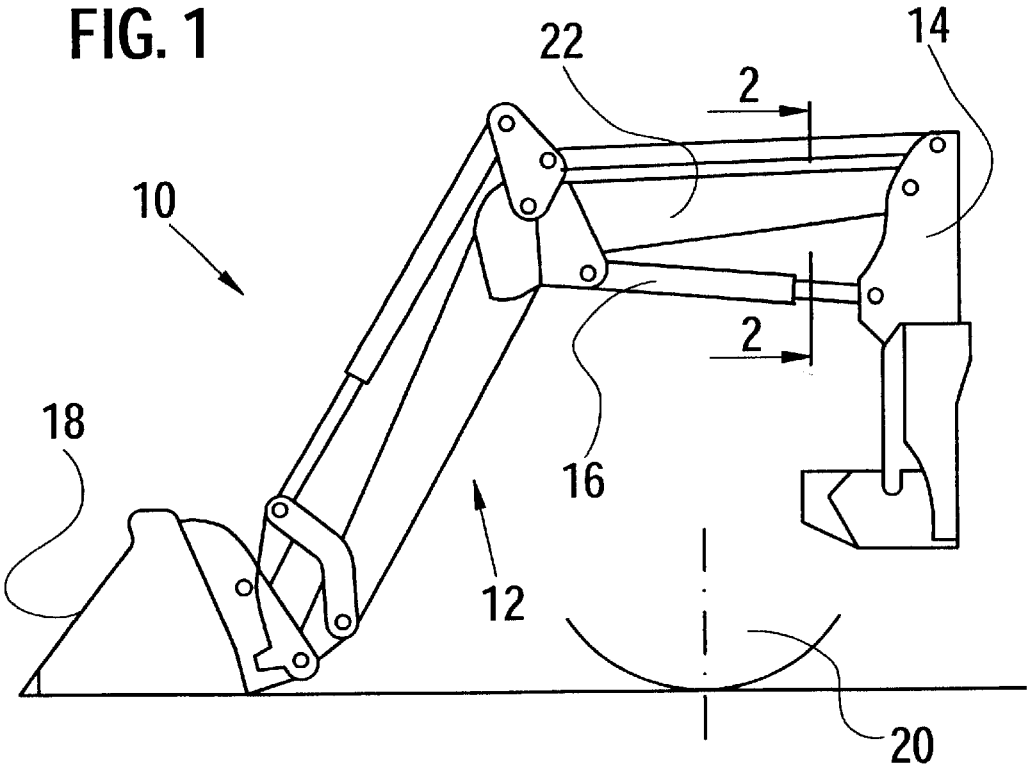
FIG. 1 is a somewhat schematic left side view of a front end loader.

Referring now to the drawings, there is shown a loader 10 including a loader boom 12, a mounting standard or bracket 14, hydraulic cylinders 16 and an implement 18, here shown as being a bucket. The loader 10 is shown disposed as if attached to a farm tractor, of which the only part shown is a portion of a steerable front wheel 20. The loader 10 is designed as a front loader that is used in particular in agriculture or in the municipal area and lifts loads up to approximately 1000 kgs.

The loader boom 12 extends between the bracket 14 and the implement 18 and has a bend of nearly 90 degrees. Due to the forces involved, the loader boom is formed of a pair of tubular boom arms 22 that are in the preferred embodiment, broadened in a tapered fashion, in the plane of the drawing, up to the bend.

One mounting standard or bracket 14 is associated with each boom arm 22 and serves to connect the rear end of the associated arm to the farm tractor for pivoting vertically about a horizontal transverse axis.

The hydraulic cylinders 16 effect the vertical movement of the loader boom 12 and are supported at one end on an associated one of the brackets 14 and at the other end on the associated one of the boom arms 22 in its vertically pivotable bending zone. The hydraulic cylinders 16 are coupled to a hydraulic system located on the tractor and are controlled in a known manner. Additional hydraulic cylinders are provided in a known manner between the loader linkage arm 12 and the implement 18, but they are not considered further.

Figure 2:
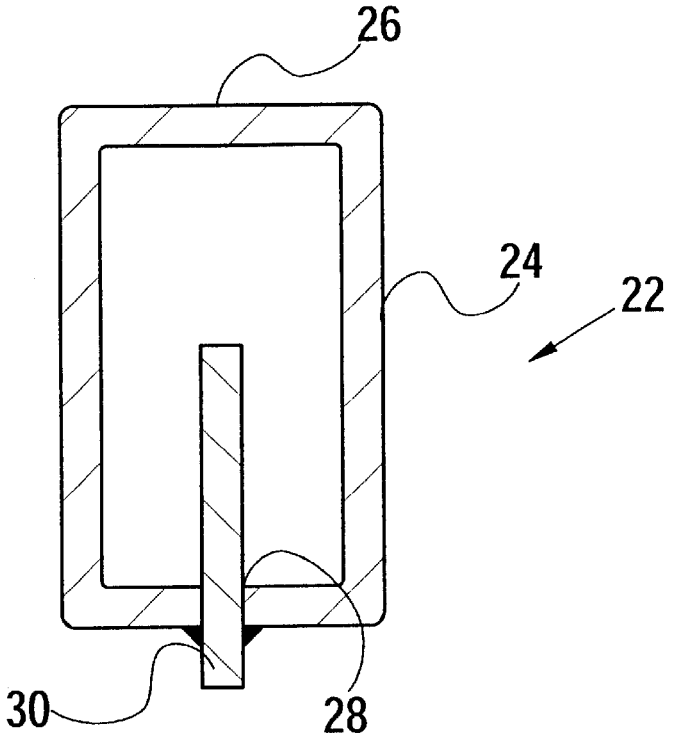
FIG. 2 is a vertical sectional view taken along line 2—2 of FIG. 1.

The loader arm 22 is depicted in detail in cross section in FIG. 2 and includes opposite parallel walls 24 as high webs, narrow sides 26 as cross webs, a gap 28 and an inserted bar 30.

The loader arm 22 is designed as a tapered rectangular tube that is formed of an approximately 6–10 mm thick plate. The steel plate is stamped, cut, or shaped in another manner according to the developed view of the support arm 22 and then is correspondingly bent 90° in the same direction each time. The blank of material is sized and the bending is done so that the gap 28 remains defined between spaced parallel ends of the formed blank. While four right-angle bends are provided in the embodiment shown, a round, pentagonal, hexagonal, or other tube cross-section could also be provided. The position shown in FIG. 2 matches the actual positional situation.

At any given section along the length of the arm 22, the walls 24 are parallel to each other as are the narrow walls 26, with the walls meeting so as to form right angled corners. The lower wall 26 could be called an interrupted narrow side in-as-much as it is interrupted by the gap 28. However, considering the whole length of the arm 22 between the standard 14 and the bend, the walls 24 increase in height from the standard 14 while the upper and lower walls 26 diverge from each other.

The width of the gap 28 corresponds essentially to the width of the bar 30. If a clearance fit is selected, the bar 30 can be easily shoved into the gap 28 and be held by means of an appliance until it is welded to the opposite parts of the lower narrow side 26. Instead of such a holding appliance, the walls 24 could be pressed towards each other to hold the bar 30 between them by friction. In the case of a press fit between the gap 28 and the bar 30, the gap 28 is first opened somewhat, the bar 30 inserted, then the wall portions at the opposite sides of the bar 30 released so as to press against the bar 30. Alternatively, the widening can be simply achieved by slightly chamfering the end of the bar 30 entering through the gap 28 into the interior of the arm 22, in which case the bar is forced sufficiently to overcome the squeezing force of the interrupted lower wall 26.

The bar 30 is formed from flat steel and is uniformly rectangular. In the embodiment shown, the bar 30 projects beyond approximately half the height of the interior while on the other hand it projects beyond the outer surface of the arm 22 by approximately one-sixth. If the bending forces to be withstood so dictate, the bar 30 can also extend across the entire interior of the support tube 22 as well as beyond on beyond its outer surface. The bar 30 is welded to the interrupted lower wall 26 at the sides of the gap 28 by fillet welds. If the walls 24 are tapered while the bar 30 is square or rectangular, the region of the bar 30 that projects beyond the arm 22 on the outside assumes a wedge-shaped form.

In the embodiment shown, the bar 30 extends only in the region of the support tube 22 between the bend and the bracket 14. Notwithstanding, another similar bar can be provided in the region between the bend and the implement 18. Other than as shown, the bar 30 can also extend through the upper narrow side 26.

having described the preferred embodiment, it will become apparent that various modifications can be made without departing from the scope of the invention as defined in the accompanying claims.

What is claimed is:

1. In a loader boom for a front loader, wherein the boom includes tubular arms, the improvement comprising: each arm having a narrow gap of substantially constant width extending lengthwise thereof; and an elongate bar being located in said gap and welded to said arm and forming a rib located within said arm.

2. The loader boom defined in claim 1 wherein a portion of said bar is located exteriorly of said arm.

3. The loader boom defined in claim 1 wherein said arm is rectangular in cross section with said gap being located in a narrow side of said arm.

4. The loader boom defined in claim 1 wherein said gap extends an entire length of said arm.

5. The loader boom defined in claim 1 wherein said gap is located at an underside of said arm and said bar having a height dimension extending vertically within said arm.

6. A method of making a reinforced tubular loader boom arm comprising the steps of:

(a) sizing a sheet of metal stock material so as to produce a blank that is properly dimensioned to form the desired tubular arm;

(b) bending said blank into a partial tube wherein opposite ends of said blank are left disposed in confronting, parallel spaced relationship to each other so as to form a gap leading to an interior of said partial tube;

(c) inserting a bar into said gap so that it extends along and snugly engages said opposite ends of said blank and extends a preselected distance into said partial tube so as to define a rib; and (d) welding said bar to said partial tube.

* * * * *